United States Patent [19]

Haberland

[11] 4,442,816

[45] Apr. 17, 1984

[54] FUEL INJECTION PUMP FOR INTERNAL COMBUSTION ENGINES

[75] Inventor: Siegfried Haberland, Stuttgart, Fed. Rep. of Germany

[73] Assignee: Robert Bosch GmbH, Stuttgart, Fed. Rep. of Germany

[21] Appl. No.: 410,667

[22] Filed: Aug. 23, 1982

[30] Foreign Application Priority Data

Sep. 26, 1981 [DE] Fed. Rep. of Germany ..... 3138391

[51] Int. Cl.[3] ..... F02M 63/00

[52] U.S. Cl. ..... 123/457; 123/511

[58] Field of Search ..... 123/457, 460, 511, 459, 123/510

[56] References Cited

U.S. PATENT DOCUMENTS

| | | | |
|---|---|---|---|
| 2,456,605 | 12/1948 | Wirth et al. | 123/457 |
| 3,598,097 | 8/1971 | Eheim et al. | 123/511 |
| 3,730,159 | 5/1973 | Sallot | 123/457 |
| 4,040,405 | 8/1977 | Tanaka et al. | 123/457 |
| 4,187,817 | 2/1980 | Wilson et al. | 123/457 |

FOREIGN PATENT DOCUMENTS

| | | | |
|---|---|---|---|
| 2347100 | 3/1975 | Fed. Rep. of Germany | 123/457 |
| 699222 | 11/1979 | U.S.S.R. | 123/511 |

*Primary Examiner*—Ira S. Lazarus
*Assistant Examiner*—Magdalen Moy
*Attorney, Agent, or Firm*—Edwin E. Greigg

[57] ABSTRACT

The vane-cell pump of a fuel injection pump for internal combustion engines has one or more adjustable throttle restrictions disposed on the intake side and/or on the compression side.

By adjusting the particular throttle restriction, the slope of the characteristic curve of the course of the supply pump pressure can be influenced. In this way, it is possible to effect an increase in the slope over the entire rpm range, an increase only in the upper rpm range, or a lesser increase in slope only in the upper rpm range. The invention contemplates several embodiments which essentially cover location of the throttle restriction in the fuel injection pump.

3 Claims, 2 Drawing Figures

FUEL INJECTION PUMP FOR INTERNAL COMBUSTION ENGINES

BACKGROUND OF THE INVENTION

The invention relates to a fuel injection pump for internal combustion engines and more particularly to a fuel injection pump having a supply pump and a control valve for adjusting pressure in the supply pump.

In injection pumps of this kind, variance in the tolerances of individual pump elements is known to affect the slope of the characteristic curve over the course of supply pump pressure, so that the various curves are scattered over a relatively wide range. To preclude such scattering, the spring element of the injection pump adjuster is generally exchanged for one of a different characteristic. This exchange requires, first, keeping a substantial number of spring elements of varying characteristics on hand and, second, sufficient experience on the part of the service staff. The result is increased storage costs and a requirement for trained personnel.

OBJECT AND SUMMARY OF THE INVENTION

The fuel injection pump of the present invention eliminates the disadvantages of the prior art by providing for fine adjustment of the characteristic curve of the supply pump pressure. By adjusting a precisely defined pressure course or by correcting an existing pressure course, it is possible to reduce erroneous indications of "incorrect injection adjuster course" and also to reduce repair costs. Furthermore, by means of non-scattered pressure courses, it is possible to assign a control and regulation function to the pressure course.

Advantageous further embodiments of the invention are described in the dependent claims. One embodiment of the injection pump makes it possible to attain a pressure course curve over virtually the entire rpm range. In a second embodiment, it is possible to effect such an elevation of the pressure course curve over only the upper rpm range, and in a third embodiment, it is possible to lower the curve in this range. In a fourth embodiment, the throttle restriction of the injection pump can be adjusted particularly finely.

The invention will be better understood and further objects and advantages thereof will become more apparent from the ensuing detailed description of a preferred embodiment taken in conjunction with the drawings.

DESCRIPTION OF THE PREFERRED EMBODIMENT

Figure 1:
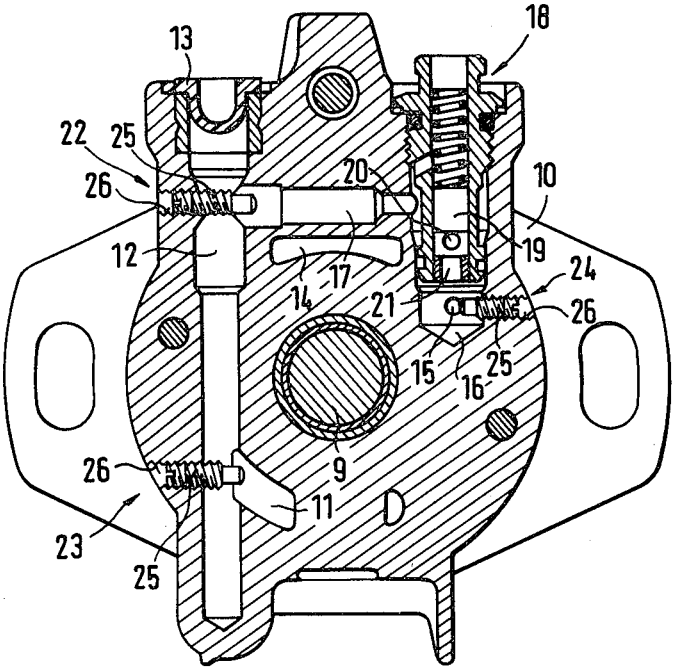
FIG. 1 is a cross section taken through the housing of a supply pump of a fuel injection pump, shown actual size.

FIG. 1 shows a detail of a vane-cell pump (not shown) of a fuel injection pump for internal combustion engines, including a drive shaft 9 for the pump rotor (not shown) and a housing 10 cooperating with it. The housing 10 has a crescent-shaped intake chamber 11, which as the intake side is connected via a pre-supply pump (again not shown) to a fuel container and communicates with an intake bore 12 closed by a plug 13. From a crescent-shaped pressure chamber 14 which embodies the compression zone of the vane-cell pump, a conduit 15 leads first to a suction chamber (not shown) of the injection pump and second to a chamber 16, which connects an overflow bore 17 with the intake bore 12.

A pressure control valve 18 having a spring-loaded piston 19 is threaded into the chamber 16, and the piston 19 effects a status on the part of a plurality of radial bores 20 which varies from open to closed, depending on the initial stress of the spring. The radial bores 20 connect the conduit 15 with the overflow bore 17 via a central stepped bore 21.

Respective throttle restrictions 22, 23, 24 are disposed in the zones of communication between the overflow bore 17 and the intake bore 12, between the intake bore 12 and the intake chamber 11, and between the conduit 15 and the chamber 16. Each throttle restriction is embodied by a threaded bolt 25 actuatable from outside the pump, which cooperates with a threaded bore 26 of the housing 10. The cross section in the communication zone at a given time is made smaller or enlarged by screwing the threaded bolt 25 farther in or by unscrewing it, so that an adjustable throttle restriction is accordingly disposed on the intake side and/or the compression side of the supply pump.

Figure 2:
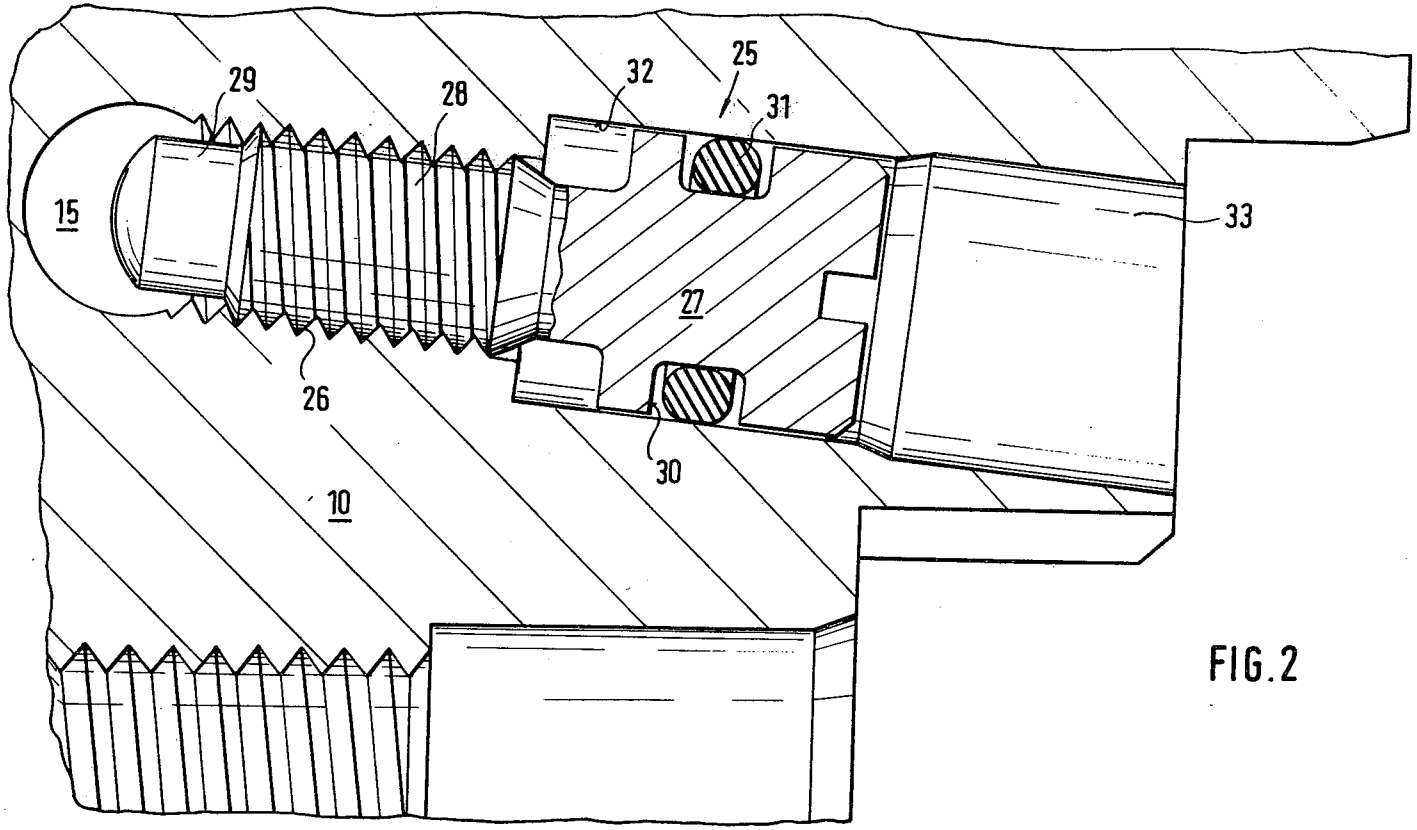
FIG. 2 is a detail including a throttle restriction, seen on an enlarged scale.

FIG. 2 shows the throttle restriction 24, which is shown only schematically in FIG. 1. The threaded bolt 25 in FIG. 2 is embodied as a slotted screw, and it has a cylindrical head 27, a threaded shank section 28 cooperating with the threaded bore 26 and a cylindrical nose section 29 protruding into the conduit 15 of the housing 10. An annular groove 30 is recessed out of the jacket of the head 27, and an O-ring 31 is placed into the annular groove, with its pressure against the wall of a bore 32 effecting the sealing of the head 27 relative to the housing 10. The bore 32 widens into a bore 33 which leads to the outside.

The foregoing relates to a preferred exemplary embodiment of the invention, it being understood that other embodiments and variants thereof are possible within the spirit and scope of the invention, the latter being defined by the appended claims.

What is claimed and desired to be secured by Letters Patent of the United States is:

1. A fuel injection pump and housing for internal combustion engines having a fuel supply pump, by means of which a suction chamber of said fuel injection pump is supplied with fuel, said chamber being under an rpm-dependent pressure, controllable by means of a pressure control valve having a piston which is acted upon by a pressure to be established, and being displaceable by said latter pressure counter to a restoring spring to thereby control an outflow cross section of an overflow conduit, said overflow conduit conntaining an adjustable throttle restriction, downstream of said throttle restriction said overflow conduit leads directly to the intake side of said fuel supply pump, wherein said throttling restriction comprises a threaded bolt, which fits into a threaded bore of said housing of said fuel injection pump and protrudes with one end thereof into said overflow conduit and is sealed off from the outside of said housing.

2. A pump as defined in claim 1, characterized in that said threaded bolt comprises a slotted screw having a cylindrical head with an annular groove disposed thereabout, and an O-ring disposed in said annular groove, said O-ring defining means for sealing off the head from the housing of the pump.

3. A pump as defined in claim 2, characterized in that said slotted screw includes a cylindrical nose section, which when screwed into or out of said housing determines the amount of the throttle restriction.

* * * * *